US006759127B1

(12) United States Patent
Smith, III et al.

(10) Patent No.: US 6,759,127 B1
(45) Date of Patent: Jul. 6, 2004

(54) TREATED INHERENTLY FLAME RESISTANT POLYESTER FABRICS

(75) Inventors: John M. Smith, III, Greensboro, NC (US); Bradley B. Coston, Greensboro, NC (US); Charles W. Duckett, Kernersville, NC (US)

(73) Assignee: Precision Fabrics Group, Inc., Greensboro, NC (US)

( * ) Notice: Subject to any disclaimer, the term of this patent is extended or adjusted under 35 U.S.C. 154(b) by 0 days.

(21) Appl. No.: 09/965,485

(22) Filed: Sep. 27, 2001

(51) Int. Cl.[7] ..... B32B 27/34

(52) U.S. Cl. ..... 428/395; 57/232; 428/370; 428/400; 442/121; 442/122; 442/123; 442/124; 442/125; 442/193; 442/197; 442/198; 442/308; 442/310

(58) Field of Search ..... 442/79, 80, 85, 442/86, 91–95, 121–125

(56) References Cited

U.S. PATENT DOCUMENTS

| | | | | |
|---|---|---|---|---|
| 4,052,158 A | | 10/1977 | Weil | 8/116 |
| 4,062,818 A | | 12/1977 | Mate | 260/17 |
| 4,067,927 A | | 1/1978 | Weil | 260/836 |
| 4,086,385 A | | 4/1978 | Rowland | 428/272 |
| 4,158,077 A | | 6/1979 | Mischutin | 427/381 |
| 4,355,065 A | | 10/1982 | DeMott | 428/195 |
| 4,395,454 A | | 7/1983 | Baldwin | 428/290 |
| 4,400,414 A | | 8/1983 | DeMott | 427/210 |
| 4,522,873 A | | 6/1985 | Akagi et al. | 428/283 |
| 4,525,409 A | | 6/1985 | Elesh | 428/193 |
| 4,623,583 A | | 11/1986 | Mischutin | 428/242 |
| 4,690,859 A | | 9/1987 | Porter et al. | 428/251 |
| 4,842,932 A | | 6/1989 | Burton | 428/375 |
| 4,909,805 A | | 3/1990 | Smith | 8/127.1 |
| 4,933,412 A | | 6/1990 | Ito et al. | 524/466 |
| 5,076,809 A | | 12/1991 | Bouglas | 8/478 |
| 5,380,802 A | | 1/1995 | Termine et al. | 525/72 |
| 5,565,265 A | | 10/1996 | Rubin et al. | 428/265 |
| 5,567,400 A | | 10/1996 | Mudge et al. | 252/8.62 |
| 5,630,846 A | | 5/1997 | Hara et al. | 8/127.1 |
| 5,856,005 A | * | 1/1999 | Gurian | 428/370 |
| 5,895,301 A | | 4/1999 | Porter et al. | 156/71 |
| 5,899,783 A | | 5/1999 | Kimbrell, Jr. et al. | 442/62 |
| 6,055,711 A | | 5/2000 | Weil et al. | 28/151 |
| 6,165,920 A | | 12/2000 | Rubin et al. | 442/226 |
| 6,253,777 B1 | * | 7/2001 | Anderson | 135/115 |

OTHER PUBLICATIONS

NFPA 701 Standard Methods of Fire Tests for Flame–Resistant Textiles and Films 1996 Edition.
DuPont Zonyl; information from the internet, copyright 1997–2001.
A Comparison of Antimicrobials for the Textile Industry by White et al.; copyright 2000.
Information on Avora FR from Kosa; undated.
Silicon Tetrahydride; information from the internet, undated.
Glass resource, Types of Sealants; information from the internet; 2000.
Silicon Damp–Course; information from the internet; undated.
Silquest A–2171 silane; information from the internet; undated.
Silicone Products—!! Silane Coupling Agents; information from the internet; undated.
Egis Environments Material Safety Data Sheet; information from the internet, undated.
An Organosilicon Chemistry Primer from Gelest, Inc. , undated.

* cited by examiner

*Primary Examiner*—Arti R. Singh
(74) *Attorney, Agent, or Firm*—MacCord Mason PLLC

(57) ABSTRACT

A textile article having flame resistant properties includes a plurality of inherently flame resistant polyester fibers formed into a fabric, and a finish on the fabric including a cyclic phosphonate flame retardant. The finish imparts a property selected from the group consisting of: a molecularly bound antimicrobial agent which is an organosilane, a fluorochemical soil and fluid repellant, and the finished textile article has a flame resistance that passes the standard method NFPA 701-1996 edition testing protocol.

24 Claims, No Drawings

TREATED INHERENTLY FLAME RESISTANT POLYESTER FABRICS

BACKGROUND OF THE INVENTION

The present invention relates to inherently flame resistant (FR) polyester fabrics and to a system for imparting soil, fluid, or microbial resistance properties to inherently flame resistant fabrics while substantially maintaining the flame resistant properties of the fabric. Inherently flame resistant polyester has been produced for applications where durable flame resistance is required. The flame resistance of the polyester is the result of incorporating an organic phosphorous compound into the polyethylene terephthalate chain during the fiber production process.

The flame resistant effect of incorporating this copolymer into a fiber results from two physical properties. First, incorporation of the copolymer makes it difficult for combustion to take place because the incorporated copolymer gives the polyester fabric a lower melting point than regular polyester. Thus, the polyester, which is a thermoplastic material, melts and shrinks away from flames. Second, if any burning does take place during the shrinkage from the flame, the phosphorous component prevents the melting drips from burning by influencing the composition of the pyrolisis gases.

Since the chemical flammability resistance is built into the polyethylene terephthalate chain, the flammability properties will not wash or dry clean out during laundering as long as proper washing procedures are followed. In contrast, topically applied flame resistant treatments are known to wash off with laundering, resulting in inconsistent flame resistant behavior over the life of the textile. Additionally, topically treated fabrics are susceptible to inconsistency of application of the FR additive, causing variable flammability results.

Inherently flame resistant polyester fabrics, including knits, wovens, and non-woven fabrics, have found a market in such diverse areas as bedding, draperies, clothing, and particularly for hospitality and medical uses. The inherent FR fabrics used in the medical, hospitality and clothing areas would also benefit from having additional properties such as soil and stain resistance and/or resistance to the growth of bacteria, fungi, yeast or algae.

Stain resistance, microbial resistance and water repellency are desirable qualities to have in many textile materials. In restaurants, for example, tablecloths are often subject to rapid water penetration and frequent staining. Hospitals also have a need to prevent staining and microbial growth on their linens, due to appearance and health-related concerns. These properties necessitate frequent cleaning and/or replacement of such items, leading to a loss of time and money.

The prior art, however, denied these users access to fabrics that are inherently FR and treated to provide these additional desirable properties. Manufacturers of inherently flame resistant fibers have specifically warned against adding chemical treatments to their fabrics because of the potential loss of the flame resistance properties. Kosa, Inc., the manufacturer of the trademarked AVORA™ for flame resistant fibers, wars that acrylic resins, silicone and fluorocarbon compounds should be avoided because of their potential for damaging the inherent flame resistant properties of the AVORA™ fabric. See Kosa, "AVORA™ FR" publication, p.6. Therefore, inherently flame resistant polyester fabrics are sold scoured substantially fee from intentional or non-intentional chemical treatments. AVORA™ FR (Kosa polyester and TREVIRA™ CS (Trevira) polyester are examples of polyethylene terephthalate incorporating organic phosphorous compounds in the fiber resulting in the resulting polyester being inherently flame retardant.

Hospitals and restaurants, in particular, have a need for inherently flame resistant linens in order to provide a safe environment for their patients and patrons. Yet these industries have no way to obtain inherently flame resistant linens with additional chemical treatments for stain resistance, microbial resistance and water repellency.

Thus, there remains a need for imparting stain, fluid and microbial resistance properties in inherently flame resistant fabric while substantially maintaining the fabric's original flame resistant characteristics.

SUMMARY OF THE INVENTION

The present invention provides an a textile article having flame resistant properties comprising a plurality of inherently flame resistant fibers formed into a fabric, and a finish on the fabric, wherein the finish imparts a property selected from the group consisting of an antimicrobial agent, a soil repellant and a fluid repellant.

DESCRIPTION OF THE PREFERRED EMBODIMENTS

In the present invention, the inherently flame resistant fiber is first made into a fabric. Any of the known methods of doing so, including weaving, knitting and non-woven fabric formation can be used. Other techniques such as tufting may also be adopted.

Once the fabric is formed, it is scoured prior to the application of the chemical treatments. Scouring removes residual processing aids, which may be present on the textile material, as well as dirt and/or oily materials. The scouring of the textile material to remove any residual textile processing aids, dirt, oil residues, and the like, can be readily accomplished by passing the textile material through an aqueous detergent. After passing the textile material through the aqueous detergent, it should be in order to remove any residual detergent.

The amount of the detergent constituent employed in the aqueous detergent containing solution can vary widely as can the type of detergent. Generally, desirable results can be obtained when the amount of the detergent constituent employed is from about 0.10 to about 1.0 weight percent, based on the total weight of the detergent solution. The detergent to be employed is typically selected from a group that does not react negatively with the fabric to be scoured or with the fabric's flame resistant properties. Typical examples of suitable detergents that can be employed in the detergent scouring of the textile material, include SOLPON 1159™ SOLPON SPI™, and PICOSCOUR JET™.

After the fabric has been scoured and rinsed, the scoured material may then be subjected to a chemical treatment step. The chemical treatment of the present invention comprises exposing the inherently FR textile material to an aqueous solution of a wetting agent and a flame retardant and one or more of: an antimicrobial agent, a water repellant agent, or a soil resistance agent.

While, not wishing to be bound to a particular theory, a flame retardant may be added to the chemical treatment composition to ensure that the inherent flame retardant remains chemical coupled with the polyester fiber. It is thought that the presence of the flame retardant in the chemical coating composition may help to kinetically drive the inherently coupled flame retardant to remain chemically bound within the polyethylene terephthalate chain of the polyester fibers. The flame retardant in the chemical coating composition is preferably the same flame retardant that comprises the inherently flame retardant fabric. Typical examples of suitable flame-retardants include Cyclic Phosphonate, APEX FLAMEPROOF #1525™, PYRON N-75™, and ANTIBLAZE NT™. The flame retardant to be added to the chemical treatment preferably comprises about 2% to about 10% by weight of the chemical treatment composition. More preferably, the flame retardant comprises about 4.8% by weight of the chemical treatment composition.

The wetting agent of the chemical coating composition reduces the hydrophobicity of the dry fabric and to ensure that the entire fabric is sufficiently contacted with all the chemical treatments. The wetting agent to be added to the chemical treatment preferably comprises between about 0.5% to about 2.0% by weight of the chemical treatment composition. More preferably, the wetting agent comprises about 0.96% by weight of the chemical treatment composition. Preferably, the wetting agent is au alcohol, More preferably, the wetting agent is an aliphatic alcohol such as Isopropanol. Typical examples or suitable wetting agents include Nonionic Ethylene Ether Condensates, such as DEXOPAL 555™, or Aqueous Cationic Non-rewetting surfactants solutions, such as MYKON NRW™.

For those cases where antimicrobial properties are desired, an antimicrobial agent is added to the chemical treatment to reduce the growth of microorganisms on the inherently flame resistant fabric. By "antimicrobial agent" is meant any substance or combination of substances that kills or prevents the growth of microorganisms, and includes antibiotics, antifungal, antiviral and antialgal agents. The antimicrobial agent can be either a "leaching" antimicrobial agent or a "molecularly bonded" antimicrobial agent. Leaching antimicrobials work by leaching or moving from the surface of the fabric to contact and kill a nearby microorganism. Molecularly bonded antimicrobial agents work by remaining affixed to the fabric and kill the microorganism as it contacts the surface to which the bonded antimicrobial has been applied. See White et al., "A Comparison of antimicrobials for the Textile Industry", www.microbeshield.com.

The antimicrobial agent to be added to the chemical treatment composition preferably comprises about 0.20% to about 2.0% by weight of the chemical treatment composition. More preferably, the antimicrobial agent comprises about 0.48% by weight of the chemical treatment composition. Typical examples of suitable antimicrobial agents include ULTRAFRESH DM 25™, an octilinone or BIOSHIELD AM 500, an organosilane. Preferably, the antimicrobial agent is a "molecularly bonded" antimicrobial agent. More preferably, the antimicrobial agent is an organofuctional silane. Even more preferably, the antimicrobial agent is an organosilane composition comprising about 16% by weight of chloropropyltrihydroxysilane and about 84% by weight of Octadecylaminodimethyltrihydroxysilypropyl Ammonium Chloride, available from Aegis under the trademark AEM 5700™.

For those cases where fluid or soil repellent properties are desired, a fluid or soil repellent agent is added to the chemical treatment composition to improve the fabric's water repellency and the fabric's resistance to staining. Also, a combination fluid repellent/soil resistant agent may be added to the chemical treatment composition. Preferably, in the present invention, the fluid repellent agent and soil resistant agent is added as a combination fluid repellent/soil resistant agent. More preferably, the fluid repellent/soil resistant agent is a fluorochemical. Even more preferably, the fluid repellent/soil resistant agent is a fluorochemical available from Dupont under the trademark ZONYL 7040™, which is a water based dispersion of fluorinated acrylic co-polymer. The combination fluid repellent/soil resistant agent to be added to the chemical treatment preferably comprises about 2% to about 10% by weight of the chemical treatment composition. More preferably, the fluid repellent/soil resistant agent comprises about 3.6% by weight of the chemical treatment composition.

The chemical treatment may be applied by various methods known in the art, such as by spraying, dipping or pad application. In a preferred embodiment, the chemical treatment is applied to the scoured fabric using a pad applicator. The pressure of the squeeze rollers is controlled to achieve a wet pick-up of between about 25% and about 60% of the chemical treatment. Preferably, the pressure of the squeeze rollers is controlled to achieve a wet pick-up of approximately 45% of the chemical composition. The chemically treated fabric is then dried through exposure to between about 320° F. and 420° F. for between about 20 seconds and 60 seconds in a hot air oven. Preferably, the fabric is dried through exposure to 380° F. for 30 seconds in a hot air oven.

EXAMPLE 1

The following is a description of one preferred method of the present invention. By way of example, an inherently flame resistant fiber, such as that marketed by Kosa, Inc., trademarked as AVORA™, is woven into a fabric and treated with a chemical composition comprising an antimicrobial agent, a fluid repellent agent, a stain resistant agent and a flame retardant such that the chemically treated fabric has a flame resistance substantially similar to untreated inherently flame resistance fabric.

In Example 1, large-scale plant trials were conducted. The AVORA™ inherently flame resistant fibers were made into a woven fabric having the properties in Table 1 was first scoured with an aqueous detergent prior to the application of chemical treatments. After thoroughly rinsing the scoured fabric, it was dried in a hot air oven.

TABLE 1

| | | | | | |
|---|---|---|---|---|---|
| Warp Yarn: | 150/60 SD RD TEXT SET AVORA FR ™ POLYESTER | | | | |
| Fill Yarn: | 2/150/60 SD RD TEXT SET AVORA FR ™ POLYESTER | | | | |
| Ends/inch: | 60 | Picks/inch: | 38 | Weight: | 5.5 osy |

A chemical treatment composition was the prepared in an aqueous-based solution comprising 0.96% by weight of Isopropanol, 4.8% by weight of FLAME RETARDANT 50™, 3.6% by weight of ZONYL 7040™ and 0.48% by weight of AEM 5700™ as seen in Table 2.

TABLE 2

| Chemical Name | General Description | Treatment | Amount (% weight) |
|---|---|---|---|
| Isopropanol | Aliphatic Alcohol | Wetting Agent | 0.96% |
| FLAME RETARDANT 50 ™ | Cyclic Phosphonate | Flame Retardant | 4.8% |
| ZONYL 7040 ™ | Fluorochemical | Fluid/Stain Repellent | 3.6% |
| AEM 5700 ™ | Organosilane | Antimicrobial | 0.48% |

The chemical treatment composition was applied to the scoured AVORA™ fabric using a pad applicator. The pressure of the squeeze rollers was controlled to achieve a wet pick-up of approximately 45% of the chemical treatment composition. The fabric was then dried through exposure to 380 F. for 30 seconds in a hot air oven. After drying, the finished fabric was tested according to standard published test protocols to assess its properties. These properties arc summarized in Table 3.

TABLE 3

| Characteristic | Test Method | Units | Results |
|---|---|---|---|
| Flammability | NFPA 701 — 1996 Edition | % Weight Loss & Afterburn Time | Warp — 22.4% Afterflame <2 sec. Passed Fill — 29.7% Afterflame <2 sec. Passed |
| Fluid Repellency | AATCC Test 22 | Spray Rating | 100 |
| Presence of Antimicrobial agent | Bromo Blue Internal PFG | Pass/Fail | Pass |

As summarized in Table 3, the post-weave chemical treatment that includes the FLAME RETARDANT 50™ has a flame resistance substantially similar to the untreated inherently flame resistance fabric. It is thought that the presence of the flame retardant in the chemical coating composition may kinetically drive the inherent flame retardant to remain chemically bound within the polytethylene terephthalate chain of the polyester fibers. The fluid repellency has an excellent spray rating resistance. Finally, the test for the presence of the antimicrobial agent also passed.

EXAMPLE 2

In Example 2, another large-scale plant trial was conducted. The AVORA™ inherently flame resistant fibers were made into a woven fabric having the properties in Table 1 was first scoured with an aqueous detergent prior to the application of chemical treatments. After thoroughly rinsing the scoured fabric, it was dried in a hot air oven.

TABLE 4

| Chemical Name | General Description | Treatment | Amount |
|---|---|---|---|
| Isopropanol | Aliphatic Alcohol | Wetting Agent | 8 lbs/ 100 gal mix |
| ZONYL 7040 ™ | Fluorochemical | Fluid/Stain Repellent | 30 lbs/ 100 gal mix |
| AEM 5700 ™ | Organosilane | Antimicrobial | 4 lbs/ 100 gal mix |

The chemical treatment composition in Table 4 was applied to the scoured fabric using a pad applicator. The pressure of the squeeze rollers was controlled to achieve a wet pick-up of approximately 45% of the chemical treatment composition. The fabric was then dried through exposure to 380 F. for 30 seconds in a hot air oven.

TABLE 5

| Characteristic | Test Method | Units | Results |
|---|---|---|---|
| Flammability | NFPA 701 — 1996 Edition | % Weight Loss & Afterburn Time | Warp — 17.1% Afterflame >2 sec. Failed Fill — 24.1% Afterflame <2 sec. Failed |

After drying, the finished fabric was tested according to standard published test protocols to assess its flame resistance properties. As summarized in Table 5, the post-weave chemical treatment in Table 4, which omits the FLAME RETARDANT 50™, failed the NFPA 701-1996 Edition flame resistance test. (The fill data is not required for NFPA 701 test)

As taught by the Kosa, "AVORA™ FR" publication, the inherently flame resistance properties of the AVORA™ fabric degrade after a post-weave chemical treatment. However, the present inventor has found that if a flame retardant is added during the chemical treatment coating process, the fabric retains a flame resistance substantially similar to untreated inherently flame resistance fabric.

EXAMPLE 3

In Example 3, a small-scale lab trial was conducted. The AVORA™ inherently flame resistant fabric having the properties in Table 1 was first scoured with an aqueous detergent prior to the application of chemical treatments. After thoroughly rinsing the scoured fabric, it was dried in a hot air oven.

The chemical treatment composition in Table 6 was applied to the scoured AVORA™ fabric using a pad applicator. The pressure of the squeeze rollers was controlled to achieve a wet pick-up of approximately 45% of the chemical treatment composition. The fabric was then dried through exposure to 375 F for 1 minute in a hot air oven. After drying, the finished fabric was tested according to standard published test protocols to assess its flame resistance properties.

TABLE 6

| Chemical Name | General Description | Treatment | Amount |
|---|---|---|---|
| ZONYL 7040 ™ | Fluorochemical | Fluid/Stain Repellent | 30 g/400 mL mix |
| **Characteristic Tested** | **Test Method** | **Units** | **Results** |
| Flammability | NFPA 701 — 1996 Edition | % Weight Loss & Afterburn Time | Warp — 20.9% Afterflame <2 sec. Passed Fill — 27.3% Afterflame <2 sec. Passed |

Several further small-scale lab trials were then conducted. The lab procedures followed were identical to that in Example 3. The only differences between Examples 4–8 were the types of chemical treatments applied. The treatments for each Example in 4–8 are summarized in Tables 7–11. The results of the NFPA 701-1996 Edition flame resistance tests are also summarized in Tables 7–11.

EXAMPLE 4

TABLE 7

| Chemical Name | General Description | Treatment | Amount |
|---|---|---|---|
| AEM 5700 ™ | Organosilane | Antimicrobial | 4 g/400 mL mix |
| **Characteristic Tested** | **Test Method** | **Units** | **Results** |
| Flammability | NFPA 701 — 1996 Edition | % Weight Loss & Afterburn Time | Warp — 17.9% Afterflame <2 sec. Passed Fill — 22.0% Afterflame <2 sec. Passed |

EXAMPLE 5

TABLE 8

| Chemical Name | General Description | Treatment | Amount |
|---|---|---|---|
| FLAME RETARDANT 50 ™ | Cyclic Phosphonate | Flame Retardant | 40 g/400 mL mix |
| PICOSOFT CHP ™ | | Softener | 20 g/400 mL mix |
| **Characteristic Tested** | **Test Method** | **Units** | **Results** |
| Flammability | NFPA 701 — 1996 Edition | % Weight Loss & Afterburn Time | Warp — 20.4% Afterflame <2 sec. Passed Fill — 27.0% Afterflame <2 sec. Passed |

EXAMPLE 6

TABLE 9

| Chemical Name | General Description | Treatment | Amount |
|---|---|---|---|
| AEM 5700 ™ | Organosilane | Antimicrobial | 4 g/400 mL mix |
| ZONYL 7040 ™ | Fluorochemical | Fluid/Stain Repellent | 30 g/400 mL mix |
| PICOSOFT CHP ™ | | Softener | 20 g/400 mL mix |
| **Characteristic Tested** | **Test Method** | **Units** | **Results** |
| Flammability | NFPA 701 — 1996 Edition | % Weight Loss & Afterburn Time | Warp — 23.7% Afterflame <2 sec. Passed Fill — 26.0% Afterflame <2 sec. Passed |

EXAMPLE 7

TABLE 10

| Chemical Name | General Description | Treatment | Amount |
|---|---|---|---|
| ZONYL 7040 ™ | Fluorochemical | Fluid/Stain Repellent | 30 g/400 mL mix |
| FLAME RETARDANT 50 ™ | Cyclic Phosphonate | Flame Retardant | 40 g/400 mL mix |
| **Characteristic Tested** | **Test Method** | **Units** | **Results** |
| Flammability | NFPA 701 — 1996 Edition | % Weight Loss & Afterburn Time | Warp — 25.7% Afterflame <2 sec. Passed Fill — 28.2% Afterflame <2 sec. Passed |

EXAMPLE 8

TABLE 11

| Chemical Name | General Description | Treatment | Amount |
|---|---|---|---|
| AEM 5700 ™ | Organosilane | Antimicrobial | 4 g/400 mL mix |
| FLAME RETARDANT 50 ™ | Cyclic Phosphonate | Flame Retardant | 40 g/400 mL mix |
| **Characteristic Tested** | **Test Method** | **Units** | **Results** |
| Flammability | NFPA 701 — 1996 Edition | % Weight Loss & Afterburn Time | Warp — 28.2% Afterflame <2 sec. Passed Fill — 24.7% Afterflame <2 sec. Passed |

While not wishing to be bound by any particular theory, after summarizing the small-scale experiments in Tables 7–11, it was thought that the addition of flame retardant to the chemical treatments does not harm the flame resistant properties of untreated inherently FR fibers and may, in some cases with heavy chemical loading, assist in kinetically driving the inherent flame retardant to remain chemically bound within the polyethylene terephthalate chain of the polyester fibers. But, it is not a requirement for the present invention to require the addition of flame retardant to the desired chemical treatment in order for the treated fabric to have an equal flame resistance to the untreated inherently FR fibers. Therefore, the present invention, unlike the prior art teachings, has unexpectedly found that the addition of chemical treatments to inherently FR fibers, has substantially equal flame resistance as compared to untreated inherently FR fibers.

EXAMPLE 9

Another inherently resistant fiber, TREVIRA CS™ is similar to AVORA™, the two fibers having previously been available as European and American versions of the product from the same manufacturer, which has recently been divided into two separate organizations, each selling its own inherently FR fiber.

Accordingly, TREVIRA CS™ fibers was also tested in a woven fabric having the following construction:

| Warp | | Filling | |
|---|---|---|---|
| Denier | 165 | Denier | 165 |
| Filaments | 64 | Filaments | 64 |
| X-section | trilobal | X-section | trilobal |
| Luster | bright | Luster | bright |
| Textured | no | Textured | no |
| Fiber | polyester | Fiber | polyester |

Without finishing the fabric had these NFPA 701 Burn Test Results:

| | % Weight Loss | Afterburn <2 sec. |
|---|---|---|
| Warp | 9.3% | Afterflame <2 sec. Pass |
| Fill | 10.9% | Pass |

An additional sample of TREVIRA CS of the same construction was finished with:

| Chemical Name | General Description | Treatment | Amount |
|---|---|---|---|
| ZONYL 7040 ™ | Fluorochemical | Fluid/Stain Repellent | 30 g/400 mL |
| AEM 5700 ™ | Organosilane | Antimicrobial | 4 g/400 mL |

The fabric was dried through exposure to 375° F. for 1 minute in a hot air oven. The pad pressure was 6 psi and the air flow set at 100%. The finished fabric was tested with these results:

| Characteristic Tested | Test Method | Units | Results |
|---|---|---|---|
| Flammability | NFPA 701 — 1996 Edition | % Weight Loss & Afterburn Time | Warp — 12.6% Afterflame <2 sec. Passed Fill — 10.4% Afterflame <2 sec. Passed |
| Fluid Repellency | AATCC Test 22 | Spray Rating | 100 |
| Presence of Antimicrobial agent | Bromo Blue Internal PFG | Pass/Fail | Pass |

It should now be understood by those skilled in the art that the amounts and ratios of the chemical treatment compositions as well as the type of treatment desired may be varied depending on the desired result of the chemical coating treatment. It should also be understood that all such modifications and improvements have been deleted herein for the sake of conciseness and readability but are properly within the scope of the following claims.

We claim:

1. A textile article having flame resistant properties comprising a plurality of inherently flame resistant fibers formed into a fabric, and a finish on the inherently flame resistant fibers of the fabric, wherein the finish imparts a property selected from the group consisting of: one or more of an antimicrobial agent, a soil repellant aid a fluid repellant.

2. The textile article according to claim 1 wherein the finished textile article has a flame resistance that passes the standard method NFPA 701-1996 edition testing protocol.

3. The textile article according to claim 1 wherein the article is made of polyester fibers.

4. The textile article according to claim 3 wherein the article is made AVORA™ polyester fibers incorporating organic phosphorous compounds.

5. The textile article according to claim 1 wherein the antimicrobial agent is a molecularly bound antimicrobial agent.

6. The textile article according to claim 5 wherein the antimicrobial agent is an organosilane.

7. The textile article according to claim 6 wherein the antimicrobial agent is Octadecylaminodimethyltrihydroxysiylpropyl Ammonium Chloride.

8. The textile article according to claim 1 wherein the fluid repellent is a fluorochemical.

9. The tactile article according to claim 8 wherein the fluid repellent is also a soil repellent.

10. The textile article according to claim 9 wherein the fluid repellent is a water based dispersion of fluorinated acrylic co-polymer.

11. The textile article according to claim 1 wherein the textile article is a bedspread.

12. The textile article according to claim 1 wherein the textile article is a drapery.

13. The textile article according to claim 1 wherein the textile article is upholstery fabric.

14. The textile article according to claim 1 wherein the finish includes a flame retardant.

15. The textile article according to claim 14 wherein the flame retardant is a phosphonate.

16. The textile article according to claim 15 wherein the flame retardant is a cyclic phosphonate.

17. The textile article according to claim 16 wherein the finish includes FLAME RETARDANT 50™ cyclic phosphonate flame retardant.

18. The textile article according to claim 1 wherein the article is made from TREVIRA CS™ fibers of polyester incorporating organic phosphorous compounds.

19. A textile article having flame resistant properties comprising a plurality of inherently flame resistant polyester fibers formed into a fabric, and a finish on the fabric including a cyclic phosphonate flame retardant, wherein the finish includes a molecularly bound antimicrobial agent which is an organosilane, and a fluorochemical soil and fluid repellent, and wherein the finished fabric has a flame resistance that passes the standard method NFPA 701-1996 edition testing protocol.

20. A textile article having flame resistant properties comprising a fabric consisting of a plurality of inherently flame resistant fibers, and a finish on the fabric containing a fluorochemical, a cyclic phosphonate and an organosilane.

21. The textile article according to claim 20 wherein the finished textile article has a flame resistance that passes the standard method NFPA 701-1996 edition testing protocol.

22. A textile article having flame resistant properties comprising a plurality of inherently flame resistant fibers formed into a fabric formed entirely of the inherently flame resistant fibers, and a finish on the fabric, wherein the finish imparts a property selected from the group consisting of: one or more of an antimicrobial agent, a soil repellant and a fluid repellant.

23. A textile article having flame resistant properties comprising a fabric formed of yarns, at least some of the yarns being formed entirely of a plurality of inherently flame resistant fibers, and a finish on the fabric, wherein the finish imparts a property selected from the group consisting of: one or more of an antimicrobial agent, a soil repellant and a fluid repellant.

24. A textile article having flame resistant properties comprising a homogeneous mixture of inherently flame resistant fibers formed into a fabric, and a finish on the fibers of the fabric, wherein the finish imparts a property selected from the group consisting of one or more of antimicrobial, soil repellant and fluid repellant.

* * * * *